US005447182A

United States Patent [19]

Gehrig

[11] Patent Number: 5,447,182

[45] Date of Patent: Sep. 5, 1995

[54] PROCESS FOR WEAVING A THREE WEFT LOOP FABRIC AND PRODUCT THEREOF

[75] Inventor: Hans-Jörg Gehrig, Henggart, Switzerland

[73] Assignee: Sulzer Ruti AG, Ruti, Switzerland

[21] Appl. No.: 180,402

[22] Filed: Jan. 11, 1994

[30] Foreign Application Priority Data

Mar. 30, 1993 [EP] European Pat. Off. ..... 93810226

[51] Int. Cl.[6] ..... D03D 27/08; D03D 39/22

[52] U.S. Cl. ..... 139/396; 139/25

[58] Field of Search ..... 139/396, 25, 211, 397, 139/398, 408, 409

[56] References Cited

U.S. PATENT DOCUMENTS 1,925,459 9/1933 Parker .
3,030,691 4/1962 Law .
3,721,272 3/1973 Hager .
4,984,606 1/1991 Moore et al. ..... 139/396 X

FOREIGN PATENT DOCUMENTS 1.465.855 11/1967 France .

OTHER PUBLICATIONS

Pp. 8 and 13 from "Terry Fabrics", by E. Meier, published Nov. 10, 1989, by Sulzer Bros., Ltd., 8630 Rüti, Switzerland.

*Primary Examiner*—Andrew M. Falik
*Attorney, Agent, or Firm*—Townsend and Townsend Khourie and Crew

[57] ABSTRACT

By the use of two picks without weft yarn (5, 6) during the pile change for three-weft pile fabrics, the same tying off is achieved as in a pile change for four-weft pile fabric. A three-weft terry cloth consequently has a fabric appearance which resembles the fabric appearance of a four-weft terry cloth.

7 Claims, 1 Drawing Sheet

PROCESS FOR WEAVING A THREE WEFT LOOP FABRIC AND PRODUCT THEREOF

The present invention relates to a three-weft loop fabric and also a process for manufacturing the loop fabric.

BACKGROUND OF THE INVENTION

Loop fabrics, in particular terry cloth, are normally manufactured as three-weft or four-weft goods. The manufacture of four-weft goods is associated with higher costs and is therefore only specified in determined cases. By far the greatest part of terry cloth is manufactured as three-weft goods. The terry goods may have pile loops on one side, on both sides and/or on alternate sides. The appearance of the terry goods and their quality is substantially influenced by the pile change, i.e. in the mutual change of the pile loops from one side of the goods to the other. Although clean contour edges are obtained with four-weft goods, this is only the case to a limited extent with three-weft goods.

In the so called "BV pile change" (Burkhart-Vossen), clean contour edges are in fact obtained, but the pile thread is not securely tied up, because with this weave structure no ground warp change occurs and it can therefore be easily pulled out.

In the so called "Southern German pile change", the pile loops on both sides of the transition do not have the same height as in the remaining fabric surface, but on the other hand the loop strength is admittedly good because the loop thread is retained in crossing points of the ground warp.

A three-weft loop fabric is disclosed, in which the pile thread loops have the same loop height even during the pile change. For this purpose during the pile change a fourth pick and two picks without weft yarn are provided in the foundation and pile thread weave in order to securely tie in the pile thread during the transition. In order to achieve this during the pile change and during the insertion of the picks without weft yarn, the fabric feed is interrupted.

The advantages of the invention are essentially regarded as being that the pile loops in the region of the pile change have the same height as in the remaining fabric surface and that the pile thread in the region of the pile change is securely tied up. This process is universal in the manufacture of three-weft loop fabric and can be used without conversion in every conventional loom and also in modern looms with a missed pick device.

BRIEF DESCRIPTION OF THE DRAWINGS

The invention is explained below by means of the attached drawings.

DESCRIPTION OF THE PREFERRED EMBODIMENT

The Figures show a terry cloth having pile loops on both sides, whereby the pile loops change from one side of the fabric to the other as a result of the respective change of pile.

Figure 1:
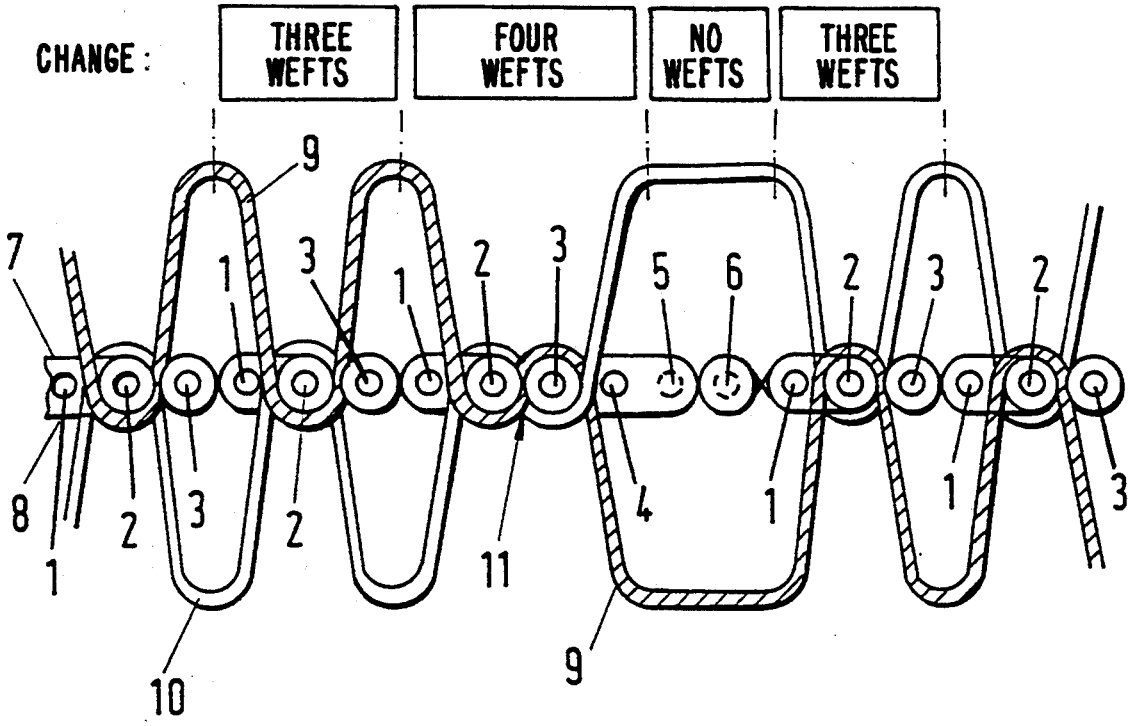
FIG. 1 shows a diagram of the pile weave with pile change of an embodiment of a three-weft terry cloth according to the invention.
Figure 2:
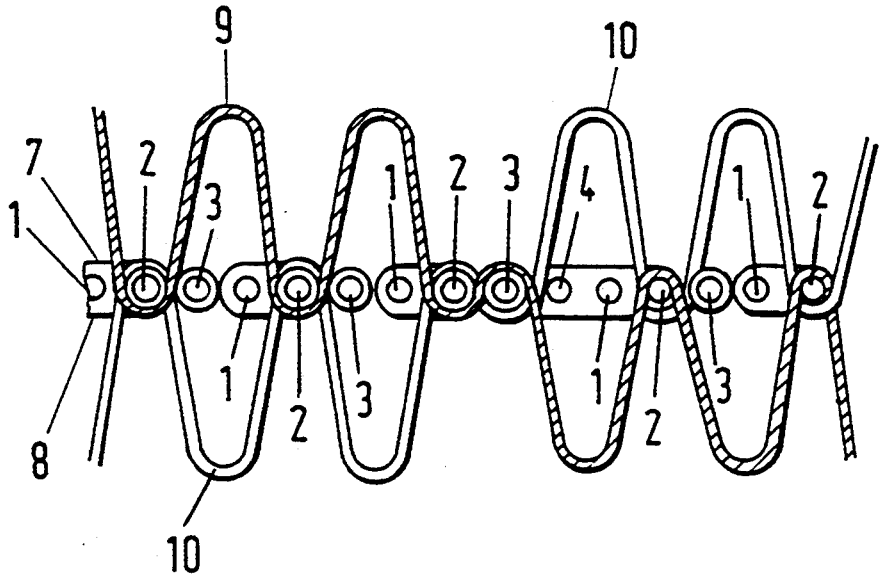
FIG. 2 shows a diagrammatical representation of the pile weave within the three-weft terry cloth as a result of the change of pile according to the invention shown in FIG. 1.

The process for the manufacture of a terry cloth according to the invention is described by means of FIGS. 1 and 2.

As is normal in three-weft terry cloth, two picks 1, 2 are firstly beaten home (partial beat-ups). Together with the third pick 3, the two beaten-home picks 1, 2 are completely beaten-up over the crossed back warp threads 7, 8 at the woven fabric (so called complete beat-up). The lightly stretched pile threads 9, 10 are tied around the second beaten-home pick 2 by crossing the back warp 7, 8.

A pile change as specified by the present invention differs from the normal pile change method (BV or Southern German change) as follows: As mentioned above, the third pick 3 is completely beaten home over the crossed back warp. With the crossing, i.e. with the change of shed for the back warp there simultaneously occurs a change of shed, i.e. change of pile for the pile warp threads 9 and 10, as characterized by position 11 in FIG. 1. After this change of pile for the pile warp threads 9 and shed, there follows an extra pick 4 and two picks without weft yarn 5 and 6. During the extra pick 4 and the picks without weft yarn the fabric feed for winding the terry cloth and the drive for the back warp is interrupted, without however at the same time interrupting the pile warp feed.

This procedure avoids firstly the reduction in the length of the loops caused during the above-mentioned South German pile change (because of the absence of the normal thread length for the simultaneous formation of a primary and secondary loop), and secondly the extra pick 4 enables, in contrast to the mentioned BV change, an S-shaped looping of the picks 2 and 3 by the pile threads 9 and 10. The extra pick 4 and the picks without weft yarn 5 and 6 to a certain extent represent an auxiliary three-weft repeat, whereby the extra pick 4 remaining in the fabric results as a so called "four weft change" inside a "three weft" terry cloth.

After that with the partial picks 1 and 2, and also with pick 3 and a complete beat-up, there occurs the continuation of the weaving process of the three-weft terry fabric up to a next "four weft" pile change specified by the program in the manner described above.

As FIG. 2 shows, at the site of the weave change the three-weft terry cloth has the same fabric appearance as the four-weft terry cloth, i.e. the height of the loops is the same on both sides of the transition and on both sides of the fabric.

The above description relates to a loop fabric having loops on both sides. It is evident to the person skilled in the art that the same weave change can also be used for loop fabric with loops on one side.

I claim:

1. In a process for weaving three-weft loop fabric having weaving steps including:

providing and feeding warp threads;

providing at least a first pick, a second pick, and a third pick crossing the warp threads;

providing and feeding pile thread parallel to the warp threads;

inserting the first pick and the second pick with the warp threads enclosing the first pick and the second pick in side-by-side relation with the pile thread crossing the second pick at an adjustable distance from the fabric;

partially beating up the first pick and the second pick to the fabric;

inserting the third pick with the warp threads enclosing the third pick;

fully beating up the third pick to push the first pick, the second pick, and the third pick over the warp threads to a fell of the cloth to cause the pile threads crossing the second pick to establish pile thread loops on at least one side of the fabric; and, periodically changing the pile thread loops from one side of the fabric to the other side of the fabric; and, taking up the woven fabric at a fabric feed;

an improvement for periodically changing the pile thread loops from one side of the fabric to the other side of the fabric comprising the further steps of:

after the changing of the pile thread loops inserting a fourth pick followed by fifth and sixth picks without weft thread yarn are provided before repeating the first and second picks in order to securely tie up the pile thread with an S-shaped curve around the second and third picks before the changing of the pile thread loops.

2. In a process for weaving three-weft loop fabric having the weaving steps of claim 1 and wherein the pile thread loops are woven from one side respectively.

3. In a process for weaving three-weft loop fabric having the weaving steps of claim 1 and wherein the pile thread loops are woven simultaneously from both sides respectively.

4. In a process for weaving three-weft loop fabric having the weaving steps of claim 1 and wherein:

during insertion of the fourth pick and during the following two picks without weft thread yarn the fabric feed and warp thread feed is interrupted.

5. A three-weft loop fabric including:

warp threads;

at least a first pick, a second pick, and a third pick crossing the warp threads;

pile thread parallel to the warp threads;

the first pick and the second pick with the warp threads enclosing the first pick and the second pick in side-by-side relation with the pile thread crossing the second pick at an adjustable distance from the fabric;

the third pick with the warp threads enclosing the third pick;

the first pick, the second pick, and the third pick over the warp threads to the fabric to cause the pile threads crossing the second pick to establish pile thread loops on at least one side of the fabric; and, the pile thread loops periodically changing from one side of the fabric to the other side of the fabric;

the improvement comprising:

after the changings of the pile threads from one side of the fabric to the other side of the fabric, said cloth including:

a fourth pick;

fifth and sixth picks without weft thread yarn following said forth pick and before repeating the first and second picks;

the pile thread having an S-shaped curve around the second and third picks before the changing of the pile thread loops.

6. A three-weft loop fabric according to claim 5 and wherein:

the pile thread loops are woven from one side of said fabric only.

7. A three-weft loop fabric according to claim 5 and wherein:

the pile thread loops are woven simultaneously from opposite sides of the fabric.

* * * * *